US005379794A

United States Patent [19]

Brown

[11] Patent Number: 5,379,794

[45] Date of Patent: Jan. 10, 1995

[54] GAS CONTROL VALVE HAVING POLYMERIC MATERIAL BODY COMBINED WITH THERMALLY RESPONSIVE GAS SHUTOFF VALVE HAVING METALLIC BODY

[75] Inventor: Bernard T. Brown, St. Louis, Mo.

[73] Assignee: Emerson Electric Co., St. Louis, Mo.

[21] Appl. No.: 186,167

[22] Filed: Jan. 25, 1994

[51] Int. Cl.[6] ..... F16K 17/40

[52] U.S. Cl. ..... 137/75; 137/613; 251/368

[58] Field of Search ..... 251/30.01, 30.02, 368, 251/129.15; 137/613, 75

[56] References Cited

U.S. PATENT DOCUMENTS

| | | | |
|---|---|---|---|
| 4,348,006 | 9/1982 | Schmitt et al. | 251/288 |
| 4,424,830 | 1/1984 | Arnsperger et al. | 137/613 |
| 4,502,661 | 3/1985 | Swanson | 251/30 |
| 4,695,602 | 9/1987 | Crosby et al. | 524/439 |
| 4,844,112 | 7/1989 | Pick et al. | 137/15 |
| 5,020,563 | 6/1991 | Hoffman et al. | 137/75 |

OTHER PUBLICATIONS

White-Rodgers' brochure "36E Gas Control Product Information," numbered R-3755, dated 9339 (Sep. 1993), p. 2.

*Primary Examiner*—Martin P. Schwadron
*Assistant Examiner*—Kevin L. Lee
*Attorney, Agent, or Firm*—Paul A. Becker

[57] ABSTRACT

A gas valve comprises the combination of a control valve having a valve body made of polymeric material and a thermally responsive shutoff valve having a metal valve body. The shutoff valve is connected upstream of the control valve and is adapted to be connected to a gas source. The shutoff valve is effective for terminating flow of gas to the control valve in response to exposure to an abnormal temperature value.

7 Claims, 2 Drawing Sheets

GAS CONTROL VALVE HAVING POLYMERIC MATERIAL BODY COMBINED WITH THERMALLY RESPONSIVE GAS SHUTOFF VALVE HAVING METALLIC BODY

BACKGROUND OF THE INVENTION

This invention relates to valves for controlling gas flow to gas-fired appliances, and particularly to an improved construction thereof which includes a polymeric material valve body.

Valves for controlling gas flow to gas-fired appliances, such as clothes dryers, typically incorporate valve bodies produced from metal castings. Typical of such valve bodies are those shown in U.S. Pat. No. 4,424,830. While such metallic valve bodies are quite satisfactory, it is believed that it would be a significant cost advantage to make the valve body of a polymeric material instead of metal. Cost savings would be realized, for example, due to the cost of a machine for molding a polymeric material part being considerably less than the cost of a machine for die-casting a similar metal part. Cost savings would also be realized due to longer usable life of a mold which makes a polymeric material part as compared to the life of a mold which makes a metallic part. Also, cost savings would be realized because various operations such as deburring, degreasing, and machining required for metallic parts, are not required for polymeric material parts.

SUMMARY OF THE INVENTION

An object of this invention is to provide a generally new and improved gas valve which utilizes a polymeric material body.

A further object is to provide such a valve in combination with a thermally responsive gas shutoff valve.

In the preferred embodiment, a gas control valve includes two solenoid valves and a regulator connected fluidically in series between an inlet port and an outlet port of a valve body. The valve body comprises a plurality of polymeric material parts sealed together in such a manner that the sealed joints provide gas-tight seals and are structurally strong.

The outlet port of the valve body is adapted to cooperate with a gas burner. Specifically, the outlet port is provided with a metallic insert which receives a burner orifice screw and which is adapted to be connected to an inlet portion of a gas burner. The inlet port of the valve body is connected to a thermally responsive shutoff valve which, in turn, is adapted to be connected to a gas source. The shutoff valve is provided with a metallic valve body and a thermally responsive valve means controlling the flow of gas through a passageway from the gas source to the inlet port of the gas control valve.

The shutoff valve compensates for specific limitations of the polymeric material valve body relating to mechanical strength and temperature. For example, the metallic body in the shutoff valve provides for a pipe-thread connection to the gas source, which type of connection, if it were made directly to the polymeric material valve body instead of to the metallic body in the shutoff valve, could exert a level of mechanical stress too severe for the polymeric material valve body to withstand without being damaged. Also, the shutoff valve, by virtue of a eutectic material utilized therein, ensures that gas flow to the control valve will be terminated before the polymeric material valve body reaches a temperature at which it would become structurally unstable.

The above mentioned and other objects and features of the present invention will become apparent from the following description when read in conjunction with the accompanying drawings.

DESCRIPTION OF THE PREFERRED EMBODIMENT

Figure 1:
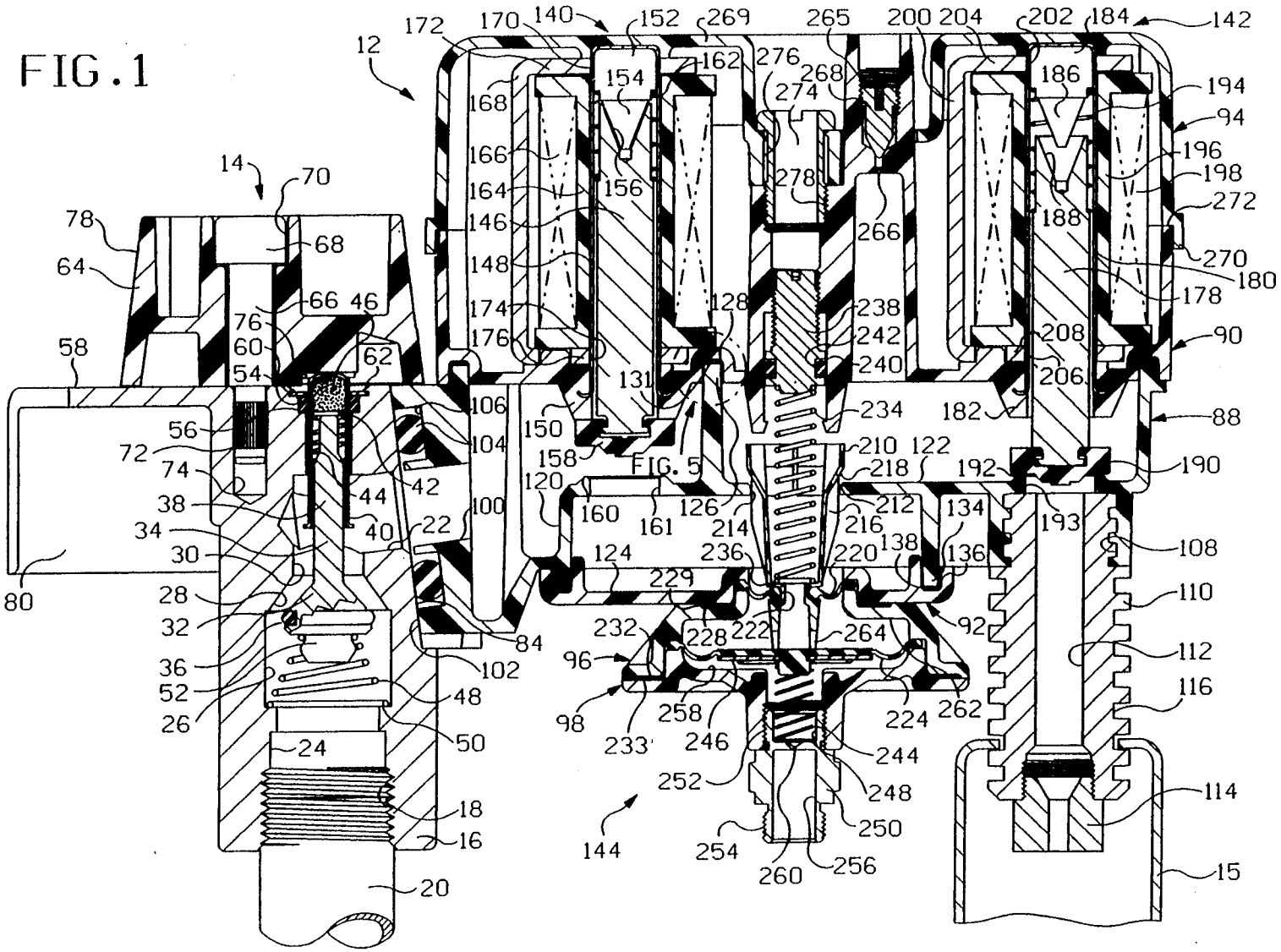
FIG. 1 is a cross-sectional view of the combined gas control valve and thermally responsive gas shutoff valve constructed in accordance with the present invention.

Referring to FIG. 1, the gas valve of this invention comprises the combination of an electrically operated control valve indicated generally at 12 and a thermally responsive shutoff valve indicated generally at 14. Control valve 12 and shutoff valve 14 are detachably connected to each other by means to be hereinafter described. In the illustrated embodiment, combined valves 12 and 14 are utilized to control the flow of gas from a gas source (not shown) to a burner, shown partially at 15, in a gas-fired clothes dryer.

Shutoff valve 14 is provided with a metallic body 16, preferably an aluminum casting. Pipe threads are provided at an inlet opening 18 to receive a threaded conduit 20 leading from the gas source. Extending between inlet opening 18 and an outlet opening 22 are gas passageways 24, 26, 28 and 30.

A lower portion 32 of a metallic valve stem 34 is provided with a rubber O-ring 36 which cooperates with passageway 28 so as to control the flow of gas, in an on and off manner, between inlet opening 18 and outlet opening 22. Passageway 28 and part of the lower portion 32 of valve stem 34 are similarly tapered so as to provide an adequate metal-to-metal gas seal in the event O-ring 36 should be damaged or destroyed. For example, O-ring 36 could be damaged or destroyed due to exposure to an abnormally high temperature and/or flame which could exist, for example, due to a fire in the dwelling in which the clothes dryer utilizing shutoff valve 14 is located.

An upper portion 38 of valve stem 34 is slidably received in a metallic tube 40. Secured in an upper closed end of tube 40 by a disc 42 and a spring 44 is a small mass 46 of a eutectic material. Disc 42 is hexagonally shaped on its outer periphery so as to enable the mass 46 of eutectic material, when it is melted, to flow downwardly between the periphery of disc 42 and the inside wall surface of tube 40.

A spring 48 is nested at one end on a shoulder 50 between passageways 24 and 26, and at its other end around a downwardly extending boss 52 of valve stem 34. Spring 48 is effective to provide a closing bias to valve stem 34. An O-ring 54 surrounds tube 40 in a snug fit and is compressed in a recess 56 extending downwardly from a top surface 58 of valve body 16 so as to prevent gas from escaping from outlet opening 22 past tube 40. O-ring 54 is secured therein by a washer 60 which is staked to valve body 16 at 62.

Figure 3:
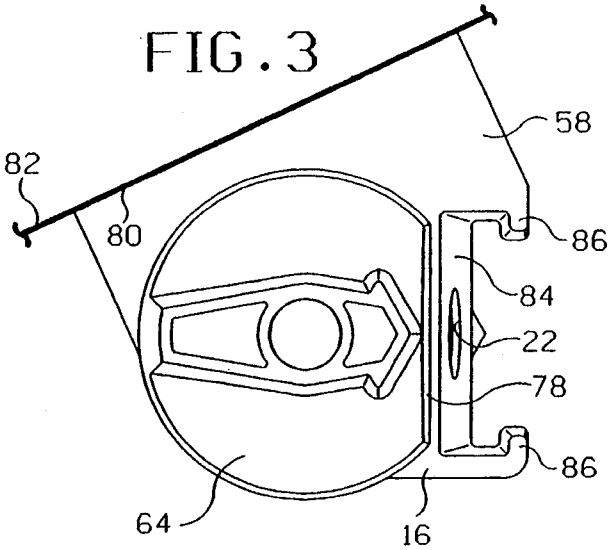
FIG. 3 is a top plan view of the shutoff valve of FIG. 2.

A knob 64, made of polymeric material, is attached by a stud 66 to valve body 16. Stud 66 includes a stepped upper portion 68 cooperative with a stepped opening 70 in knob 64 so as to enable rotation of knob 64 around stud 66 when stud 66 is secured to valve body 16. Stud 66 includes a lower knurled portion 72 which is secured in an opening 74 of valve body 16. Knob 64 is provided with a cam surface 76 which cooperates with the upper closed end of tube 40 so as to adjust the position of valve stem 34. As shown in FIG. 3, the periphery of knob 64 is circular except for a small straight portion 78.

Referring to FIG. 3, valve body 16 includes an integral flange 80 adapted to be secured by any convenient means (not shown) to a surface 82 of the clothes dryer chassis. Valve body 16 further includes a tapered surface 84 surrounding its outlet opening 22, and a pair of tabs 86 extending outwardly from tapered surface 84 and toward each other.

Control valve 12 comprises a plurality of parts made of the same polymeric material, preferably a polyphenylene sulfide (PPS) compound. Specifically, control valve 12 includes a valve body comprised of a middle body portion 88, an upper body portion 90 and a lower body portion 92, all made of the same PPS compound. Control valve 12 further includes a coil cover 94 and regulator covers 96 and 98 also made of the same PPS compound.

Middle body portion 88 is provided with an inlet opening 100 which is aligned with outlet opening 22 of valve body 16. Body portion 88 includes a tapered surface 102 surrounding its inlet opening 100, which tapered surface 102 is positioned tightly against tapered surface 84 of valve body 16 by tabs 86, shown in FIG. 3, when shutoff valve 14 and control valve 12 are connected together. An O-ring 104 adapted to be compressed in a recess 106 extending inwardly from tapered surface 102 of body portion 88 so as to prevent gas from escaping to atmosphere at the connection of tapered surfaces 84 and 102.

Middle body portion 88 is provided with an outlet opening 108. A metallic sleeve 110 is insert-molded into outlet opening 108. Sleeve 110 has an opening 112 therethrough. An orifice screw 114 is threadedly engaged to sleeve 110 at one end of opening 112. The outer surface of sleeve 110 is provided with a plurality of grooves 116. The grooved surface provides a convenient means for attaching burner 15 and provides a means for dissipating heat in the event that burner flame should exist at or near the orifice screw 114. For example, a low gas pressure condition could cause the burner flame to "burn back" at orifice screw 114. Such heat dissipation prevents body portion 88 from reaching a temperature at which it would become structurally unstable.

Middle body portion 88 is joined to upper body portion 90 to define chambers 120 and 122, and to lower body portion 92 to define chamber 124. Middle body portion 88 is provided with an upwardly extending ledge 126 which extends in a continuous loop around chambers 120 and 122. Ledge 126 is received in a groove 128 of upper body portion 90.

Figure 5:
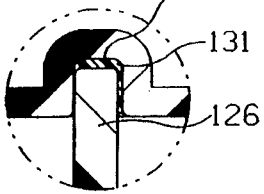
FIG. 5 is an enlarged cross-sectional view of a sealed joint, formed from the gasket of FIG. 4, between two body portions of the control valve of FIG. 1.
Figure 4:
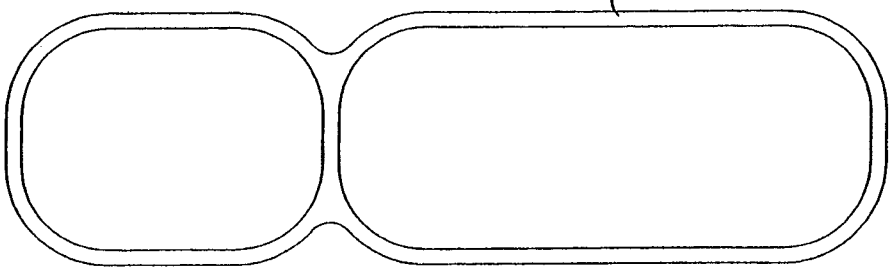
FIG. 4 is a plan view of a gasket used in the construction of the control valve of FIG. 1.

During assembly of control valve 12, a gasket 130, shown in FIG. 4, is positioned in groove 128. Gasket 130 is made of a metal-filled PPS compound. When sufficient heat is applied to the immediate vicinity of ledge 126, groove 128 and gasket 130, gasket 130 melts, forming an adhesive 131, shown more clearly in FIG. 5, which provides a gas-tight seal and a structurally strong joint between body portions 88 and 90. Preferably, the heat is applied by means of induction heating.

Middle body portion 88 is provided with a downwardly extending ledge 134 which extends in a continuous loop around chamber 124. Ledge 134 is received in a groove 136 of lower body portion 92. A gasket, made of a metal-filled PPS compound, is positioned in groove 136. When sufficient heat is applied to the vicinity of ledge 134, groove 136 and the gasket, the gasket melts, forming an adhesive 138 which provides a gas-tight seal and a structurally strong joint between body portions 88 and 92.

Control valve 12 includes two solenoid valves indicated generally at 140 and 142, and a pressure regulator indicated generally at 144.

Solenoid valve 140 includes a metallic plunger 146 slidably received in a guide sleeve 148. The lower end of guide sleeve 148 is insert-molded in a downwardly extending boss 150 of upper body portion 90. The upper end of guide sleeve 148 is closed and is slightly reduced in diameter from the remainder of guide sleeve 148 and receives, in a press fit, a metallic core member 152. The lower portion of core member 152 is provided with a conical extension 154. The upper portion of plunger 146 is provided with a conical recess 156 which cooperates with conical extension 154.

Attached to the lower end of plunger 146 is a resilient valve member 158. Valve member 158 cooperates with a valve seat 160 surrounding an opening 161 in middle body portion 88 and is biased to its closed position by a spring 162. Spring 162 is positioned between an upper portion of plunger 146 and a lower portion of core member 152.

Surrounding guide sleeve 148 is a bobbin 164 on which is wound a wire coil 166 of an appropriate gauge and number of turns of wire. The start and finish ends (not shown) of coil 166 are connected to appropriate circuitry (not shown) for controlling energizing of coil 166.

A magnetic flux path is provided by a metallic bracket 168 which has an opening 170 in a top leg 172 thereof and an opening 174 in a bottom leg 176 thereof. Guide sleeve 148 extends through openings 170 and 174.

Solenoid valve 142 is the same in construction as solenoid valve 140. Solenoid valve 142 includes a plunger 178 and a guide sleeve 180. The lower end of guide sleeve 180 is insert-molded in a downwardly extending boss 182 of upper body portion 90. Solenoid valve 142 also includes a core member 184 having a conical extension 186 which cooperates with a conical recess 188 of plunger 178, a valve member 190 which cooperates with a valve seat 192 surrounding an opening 193 in middle body portion 88, and a biasing spring 194.

Solenoid valve 142 also includes a bobbin 196 and a wire coil 198. Solenoid valve 142 further includes a bracket 200 having an opening 202 in a top leg 204 thereof and an opening 206 in a bottom leg 208 thereof. Guide sleeve 180 extends through openings 202 and 206.

Pressure regulator 144 includes a poppet valve 210 cooperative with a valve seat 212 surrounding an opening 214 in middle body portion 88. An upper portion of valve 210 is provided with a plurality of fins 216 which align valve 210 in opening 214. The fins 216 are spaced from each other around the periphery of valve 210 so as to provide passageways therebetween for gas to flow through opening 214 from chamber 124 to chamber 122. The upper portion of valve 210 is also provided with a tapered portion 218. The tapered portion 218 is effective to reduce the flow of gas through opening 214 when valve 210 moves downwardly and to increase the flow of gas through opening 214 when valve 210 moves upwardly.

A flexible diaphragm 220 is clamped at its outer periphery between lower body portion 92 and regulator cover 96, and is nested at its inner periphery in a groove 222 in a lower portion of valve 210. Another flexible diaphragm 224 is clamped at its outer periphery between regulator covers 96 and 98.

A gasket, made of a metal-filled PPS compound, is positioned in a continuous groove 228 of regulator cover 96 during assembly. Sufficient heat is then applied so as to cause the gasket to melt and thereby form an adhesive 229 which provides a gas-tight seal and a structurally strong joint between lower body portion 92 and regulator cover 96. In a similar fashion, a metal-filled PPS compound gasket is positioned in a continuous groove 232 of regulator cover 96 and when melted, forms an adhesive 233 which provides a gas-tight seal and a structurally strong joint between regulator covers 96 and 98. It is noted that the feature of a gas-tight seal provided by adhesives 229 and 233 is redundant since a gas-tight seal is provided at the clamped outer peripheries of diaphragms 220 and 224.

Poppet valve 210 is biased downwardly against diaphragm 224 by a spring 234 which rests at one end against an internal ledge 236 in valve 210 and at its other end against an adjusting screw 238. An O-ring 240 in a groove 242 of screw 238 provides a desired gas-tight seal between chamber 122 and atmosphere. Diaphragm 224 is biased upwardly against valve 210 by a spring 244. Spring 244 rests at one end against a plate 246 on the underside of diaphragm 224 and at its other end inside a cavity 248 of a screw 250. Screw 250 is provided with threads on both ends 252 and 254 so that it can be reversed. When screw 250 is reversed, spring 244 rests inside a cavity 256, thereby changing the biasing force exerted on diaphragm 224 by spring 244. In practice, screw 250 is used in one position when the gas being controlled is LP (liquid propane) and in the other position when the gas being controlled is natural gas.

Regulator cover 98, screw 250 and one side of diaphragm 224 define a chamber 258. Chamber 258 is at atmospheric pressure due to its being exposed to atmosphere through an opening 260 in screw 250. Regulator cover 96, valve 210, one side of diaphragm 220 and the other side of diaphragm 224 define a chamber 262. Valve 210 is provided with spaced openings 264 at its lower end. Chamber 262 is at the pressure existing in chamber 122 due to chamber 262 being connected to chamber 122 through openings 264 and the interior of valve 210.

Upper body portion 90 is also provided with a pressure tap fitting including a threaded recess 265 and an opening 266 between recess 265 and chamber 122. When pressure is not being checked, opening 266 is closed by a screw 268 secured in recess 265.

coil cover 94 is provided with a top portion 269 which overlies solenoid valves 140 and 142. Extending downwardly from top portion 269 is a peripheral lip 270 which overlies a top edge 272 of upper body portion 90. Coil cover 94 is secured to upper body portion 90 by a screw 274 which is captivated in an opening 276 in coil cover 94 and extends into a threaded opening 278 in upper body portion 90.

Figure 2:
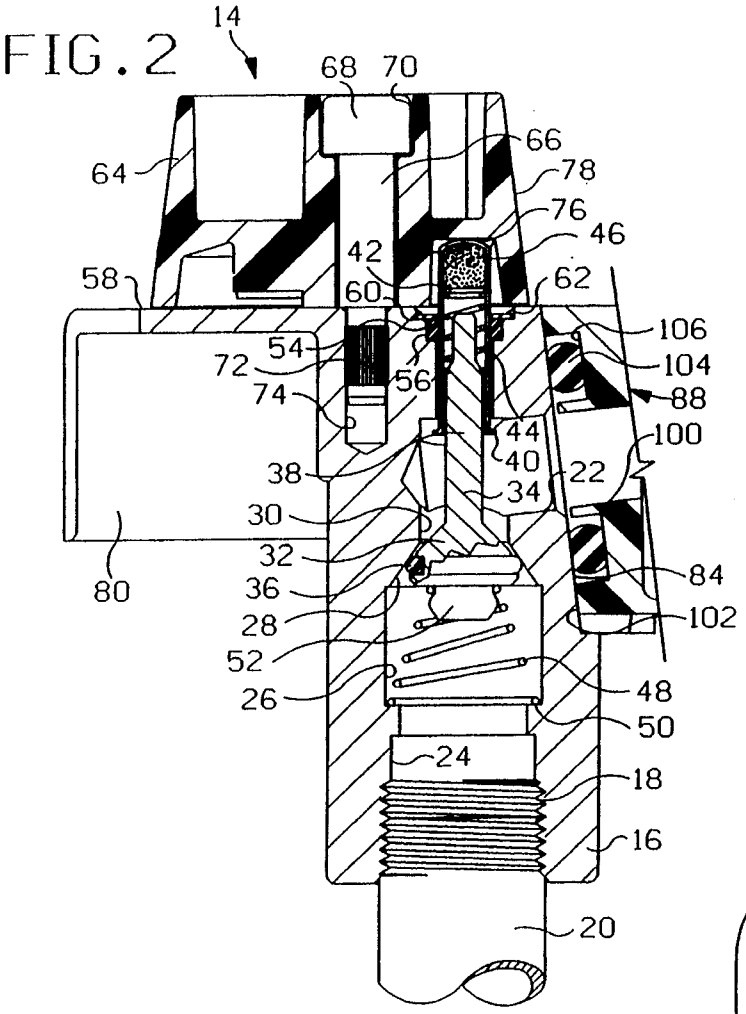
FIG. 2 is a partial cross-sectional view of the valve of FIG. 1, showing the shutoff valve components in positions initially existing when the shutoff valve is connected to the control valve.

When it is desired to connect control valve 12 to shutoff valve 14 or disconnect them from each other, knob 64 is rotated to an angular position wherein no part of knob 64 overlies middle body portion 88, such a knob position being shown in FIGS. 2 and 3. Middle body portion 88 of control valve 12 is provided with recess means (not shown) which cooperate with tabs 86 to effect sliding contact between tapered surface 84 of valve body 16 and tapered surface 102 of middle body portion 88 as such connection or disconnection is being made.

When control valve 12 and shutoff valve 14 are properly connected to each other, knob 64 can be rotated to an OFF position or to an ON position. The OFF position is attained when knob 64 is rotated 90 degrees clockwise from the position illustrated in FIGS. 2 and 3; the ON position is attained when knob 64 is rotated 180° clockwise.

As knob 64 is rotated clockwise from the position illustrated in FIGS. 2 and 3, cam surface 76 pushes downwardly on tube 40. Tube 40 is moved downwardly, compressing spring 44. In the OFF position, tube 40 has been moved downwardly, but not enough to cause disc 42 in tube 40 to be in contact with valve stem 34 so that valve stem 34 is in the same position as illustrated in FIG. 2 wherein gas flow through shutoff valve 14 is blocked.

In the ON position, such position being illustrated in FIG. 1, cam surface 76 has pushed sufficiently downwardly on tube 40 to cause disc 42 therein to contact valve stem 34 and force valve stem 34 downwardly so as to enable gas to flow through passageway 28. That is to say, gas can then flow from inlet opening 18 through passageways 24, 26, 28 and 30 to outlet opening 22. With knob 64 in the ON position, gas flow from outlet opening 22 is controlled by control valve 12.

In the preferred embodiment, control valve 12 is operated in a manner such that solenoid valve 140 is energized before solenoid valve 142. However, it is to be understood that in other embodiments, solenoid valve 140 could be energized after solenoid valve 142 or at the same time as solenoid valve 142.

When solenoid valve 140 is energized, gas can then flow from outlet opening 22 of shutoff valve 14 through inlet opening 100 of control valve 12, through chamber 120, opening 161, chamber 124, opening 214, and into chamber 122. When solenoid valve 142 is subsequently energized, gas can then flow from chamber 122 through openings 193 and 112, and through the orifice screw 114 to burner 15.

As previously described, the polymeric material used in control valve 12 is a PPS compound. The various parts made of the PPS compound are stable so long as the temperature to which they are exposed remains below a certain temperature which, in the PPS compound, is approximately 500° F. Under normal operating conditions, the temperature to which control valve 12 is exposed is well below 500° F.

In the event control valve 12 is exposed to a temperature above approximately 500° F., for example, due to a fire in a dwelling, shutoff valve 14 is also exposed. At a temperature above a value at which shutoff valve 14 would normally operate, but well below 500° F., for example, at approximately 200° F., the mass 46 of eutectic material in shutoff valve 14 will melt, enabling valve stem 34 to be moved upwardly by spring 48 and close gas passageway 28. Thus, should control valve 12 be exposed to 500° F. and subsequently become unstable, gas would not leak from control valve 12 because shutoff valve 14 would already have terminated the flow of gas to control valve 12.

It is to be noted that with the PPS compound and the 200° F. eutectic material, there is a temperature margin of approximately 300° F. between the temperature at which shutoff valve 14 closes and the temperature at which the polymeric material parts become unstable. It is to be understood that other polymeric materials and other eutectic materials could be utilized so long as, in addition to satisfying all other requirements, they provide an adequate temperature margin between the temperature at which safety valve 14 closes and the temperature at which the polymeric material parts become unstable.

In addition to providing the described high-temperature protection to control valve 12, shutoff valve 14 also provides protection to control valve 12 against a high level of mechanical stress. Specifically, valve body 16 of shutoff valve 14 is provided with a pipe-threaded inlet opening 18 which receives the pipe-threaded conduit 20. Since valve body 16 is made of metal, it can easily withstand the typical mechanical forces exerted thereon as a result of so connecting conduit 20. If such a pipe-thread connection were required to be made directly to control valve 12, that is, to a part made of a PPS compound such as middle body portion 88 except with a pipe-threaded inlet opening, it is believed that the typical mechanical forces that would be exerted on such a part would damage the part.

It is to be noted that there are polymeric materials available which would enable a valve body molded therefrom to possess sufficient mechanical strength and high temperature stability so as to enable elimination of a shutoff valve. However, the cost of such a polymeric material is such that the use of a valve body made of less expensive polymeric material combined with a shutoff valve, as in the present invention, is believed to be a considerably less expensive arrangement.

It is also to be noted that while control valve 12 and shutoff valve 14 are described herein as being detachably connected to each other, they could be modified wherein a metal body for the shutoff valve would be integral with the polymeric material valve body of the control valve. For example, the metal body could be insert-molded in the polymeric material body.

While a preferred embodiment of the present invention has been illustrated and described in detail in the drawings and foregoing description, it will be recognized that many changes and modifications will occur to those skilled in the art. It is therefore intended, by the appended claims, to cover any such changes and modifications as fall within the true spirit and scope of the invention.

I claim:

1. In a gas valve, a control valve having a valve body made of polymeric material; and a shutoff valve having a metal valve body, said control valve including electrically operated valve means for controlling flow of gas through said control valve, said shutoff valve being connected to said control valve upstream therefrom and including thermally responsive valve means effective for terminating flow of gas to said control valve in response to exposure to an abnormal temperature value.

2. The gas valve claimed in claim 1 wherein said polymeric material comprises a polyphenylene sulfide (PPS) compound.

3. The gas valve claimed in claim 2 wherein said control valve body comprises a plurality of body portions made of said PPS compound and connected together by an adhesive formed from a metal-filled PPS compound.

4. In a gas valve, a control valve including a body comprising a plurality of polymeric material body portions connected together and having an inlet and an outlet, said control valve further including electrically operated valve means in said body for controlling flow of gas from said inlet to said outlet;

a shutoff valve including a metallic body having an inlet and an outlet, said outlet of said shutoff valve body being in communication with said inlet of said control valve body, and said inlet of said shutoff valve body being adapted for connection to a gas source, said shutoff valve further including thermally responsive valve means in said shutoff valve body for controlling flow of gas from said inlet of said shutoff valve body to said outlet of said shutoff valve body, said thermally responsive valve means being effective for terminating flow of gas to said outlet of said shutoff valve body in response to exposure to a temperature value indicative of the existence of an abnormal operating condition and which value is considerably lower than a temperature value at which, if exposed thereto, said control valve body would become structurally unstable.

5. The gas valve claimed in claim 4 wherein the polymeric material of said body portions comprises a polyphenylene sulfide (PPS) compound.

6. The gas valve claimed in claim 5 wherein said body portions are connected together by an adhesive formed from a metal-filled PPS compound.

7. The gas valve claimed in claim 4 wherein said shutoff valve is detachably connected to said control valve.

* * * * *